United States Patent [19]

Imoda et al.

[11] Patent Number: 4,513,921

[45] Date of Patent: Apr. 30, 1985

[54] METHOD AND APPARATUS FOR DETECTING FLUCTUATIONS OF MONITORING STANDARD OF THREAD-KNOTTING MONITOR IN AUTO-WINDER

[75] Inventors: Kinichiro Imoda; Toshinori Kawai; Kimio Nishitani, all of Nagoya, Japan

[73] Assignee: Aichi Spinning Co., Ltd., Japan

[21] Appl. No.: 582,568

[22] PCT Filed: Jun. 18, 1983

[86] PCT No.: PCT/JP83/00198

§ 371 Date: Feb. 6, 1984

§ 102(e) Date: Feb. 6, 1984

[87] PCT Pub. No.: WO84/00148

PCT Pub. Date: Jan. 19, 1984

[30] Foreign Application Priority Data

Jun. 21, 1982 [JP] Japan ..... 57-107370

[51] Int. Cl.[3] ..... B65H 54/20; B65H 63/00

[52] U.S. Cl. ..... 242/36; 242/35.6 R; 340/679

[58] Field of Search ..... 242/36, 35.6 R; 340/679, 680

[56] References Cited

U.S. PATENT DOCUMENTS 3,294,326 12/1966 Raasch ..... 242/35.6 R
3,458,912 8/1969 Werffeli ..... 242/35.6 R
3,646,542 2/1972 Anthony ..... 340/680 X
3,648,027 3/1972 Ganong, Jr. et al. ..... 242/36 X
4,319,720 3/1982 Ueda ..... 242/36 X

FOREIGN PATENT DOCUMENTS 25450 11/1963 Japan .
14065 4/1972 Japan .
181128 12/1979 Japan .
25585 7/1980 Japan .

*Primary Examiner*—John M. Jillions
*Assistant Examiner*—Katherine Jaekel
*Attorney, Agent, or Firm*—Merchant, Gould, Smith, Edell, Welter & Schmidt

[57] ABSTRACT

A method and an apparatus for detecting fluctuations of a monitoring standard of a thread-knotting monitor of an automatic thread-knotting machine in an auto-winder by detecting if a number of operations of the thread-knotting monitor is over a predetermined range.

The number of thread-knottings performed in the automatic thread-knotting machine of the auto-winder and the number of operations of the thread-knotting monitor in said number of thread knottings are counted, a signal is emitted at the moment that the number of operations of the thread-knotting monitor reaches a predetermined upper limit, while a signal is emitted when the number of operations of the thread-knotting monitor at the moment that the number of the thread-knottings reaches a predetermined value falls under a predetermined lower limit, and fluctuations of the monitoring standard of the thread-knotting monitor are detected by means of the two signals.

5 Claims, 5 Drawing Figures

10
4
ALARM-STOPPER
111
GATE CIRCUIT
108
UPPER-LIMIT COMPARATOR
109
LOWER-LIMIT COMPARATOR
110
THREAD-KNOTTING COMPARATOR
101
UPPER LIMITER
104
FIRST COUNTER
102
LOWER LIMITER
106
SECOND COUNTER
103
THREAD-KNOTTING SETTER
2
FIRST DETECTOR
3
SECOND DETECTOR

UPPER LIMITER
UPPER-LIMIT COMPARATOR
LOWER-LIMIT COMPARATOR
LOWER LIMITER
THREAD-KNOTTING COMPARATOR
THREAD-KNOTTING SETTER
FIRST COUNTER
FIRST INDICATOR
SECOND COUNTER
SECOND INDICATOR
UPPER-LIMIT-INDICATION LAMP
LOWER-LIMIT-INDICATION LAMP
RS
A
10
101
102
103
104
105
106
107
108
109
110
111
1111
1112
1113
2
3
4
21
22
31
41

METHOD AND APPARATUS FOR DETECTING FLUCTUATIONS OF MONITORING STANDARD OF THREAD-KNOTTING MONITOR IN AUTO-WINDER

TECHNICAL FIELD

This invention relates to a method and an apparatus for detecting fluctuations of the monitoring standard of a thread-knotting monitor in an auto-winder used in a winding process of a spinning mill.

BACKGROUND ART

In the winding process of present-day spinning mills, wide use is made of auto-winders with automatic thread-knotting machines. Among these auto-winders with automatic thread knotting machines, auto-winders with movable automatic thread-knotting machines, such as the auto-winder made by Schlafhorst GmbH of West Germany, have taken the lead among auto-winders with automatic thread-knotting machines because of their superiority in the quality of the wound thread package, their reliability of operation, and their economy.

In an automatic thread-knotting machine, a broken thread is mechanically knotted and the knotted thread is immediately wound. Therefore, in comparison with an ordinary knotting method in which the thread is wound after the configuration of the thread knot is confirmed, there is a larger probability of inferior knotting in a thread knot in an auto-winder, e.g., doubling of two threads in knotting (below, "two-plied thread"), intermixing of waste thread in knotting, and irregular lengths of ends of knotted thread. The winding process is the last process in the thread-producing process, therefore, the above-mentioned inferior knotted portion is not removed in subsequent processes but is maintained as is in the thread package and supplied to the knitting process or weaving process. In present knitting processes or the weaving processes, 80% of all defects are caused by inferior thread-knotting portions in the above-mentioned winding process. Use of thread from which the inferior knotting portion is not removed decreases the product yield due to the increased rate of inferior fabric. Further, use of the inferior fabric for the finished goods decreases the quality of the finished goods.

To prevent occurrence of inferior thread knotting in the winding process during the winding process itself, automatic thread-knotting machines of recent auto-winders have been provided with thread-knotting monitors. A thread-knotting monitor is comprised of an optical device having a light-emitting element and a light-detecting element or an electrostatic-capacity measuring device for measuring the fluctuation of electrostatic capacity; a comparator for comparing the signal emitted from the measuring device with a predetermined value; and a device for cutting the thread which began to run after receipt of a signal from the comparator. The monitor is arranged adjacent to a thread-knotting mechanism of the automatic thread-knotting machine. That is, the measuring device of the thread-knotting monitor is arranged downstream of the thread-knotting mechanism in the direction of thread advance and detects the thickness of the running thread. When inferior knotting occurs and the thread continues to run as it is, the thickened thread-knotting portion is measured by the measuring device, and the comparator, in which a predetermined value, i.e., a monitoring standard, is set, compares the thickness of the thread-knotting portion with the monitoring standard. When the thickness of the thread-knotting portion is larger than the monitoring standard, the comparator emits a signal to the thread-cutting device. Thus, use of this known thread-knotting monitor enables a large reduction of inferior thread-knotting portions in a thread package. Now, a controller for adjusting the monitoring standard to set the monitoring standard to correspond to the thickness of the thread used is provided with the thread-knotting monitor.

While the above known thread-knotting monitor performs excellently to detect and remove inferior thread-knotting portions, it conversely has the following disadvantages. That is, in the measuring device used in the thread-knotting monitor, the monitoring standard tends to fluctuate with the passage of time. Further, even if the measuring device fails in operation, no means is provided for detecting this failure. Therefore, there is a possibility of thread knotting continuing without operation of the measuring device, resulting in overlooking of the occurrence of inferior thread knotting. Further, even if the thread-knotting monitor is normal, inferior thread knotting sometimes occurs due to defects in the thread-knotting mechanisms, e.g., failure of operation of a cutter. Conventional thread-knotting monitors have a disadvantage in that they operate without relation to the performance of the thread-knotting mechanism.

Therefore, when a thread-knotting monitor is used for a long time, inferior thread knotting is sometimes not removed or excess cutting occurs, i.e., inferior thread-knotting portions not requiring removal or normal thread-knotting portions are sometimes cut. Therefore it is necessary to inspect and adjust the thread-knotting monitor at constant time intervals. At present, in the case of 24-hour operation, auto-winders having the above thread-knotting monitors are inspected two to three times a day so as to eliminate the problem. Specifically, in such inspection work, the above-mentioned two-plied thread is passed through the thread-knotting monitor as an adjustment sample, and adjustments are made so that threads with inferior thread-knotting portions are reliably cut. At the same time, the measuring device and thread-knotting mechanism are inspected and defective portions are adjusted.

This inspection work requires a considerable time. A spinning mill having 30 Schlafhorst auto-winders, a representative auto-winder with a movable automatic thread-knotting machine, will have, for example, up to 150 thread-knotting monitors requiring at least 3.5 hours for inspection work. Since this inspection work must be performed at least two times per day, full-time inspection workers must be deployed, thus having a significant impact on personnel costs in the spinning factory. Further, in the case of inspection by workers, breakdowns on the measuring device occurring in the interval between inspections, e.g. 12 hours in the case of two inspections per day, are left undetected until that next inspection, resulting in inferior thread-knotting portions produced within the above time interval being passed on as is.

DISCLOSURE OF THE INVENTION

The object of the present invention is to overcome the disadvantages of the known thread-knotting monitor attached to an auto-winder and to provide a low cost, easy-to-operate method and an apparatus for detecting fluctuations of the monitoring standard of a thread-knotting monitor.

The object of the present invention is accomplished by counting the number of thread knottings by an automatic thread-knotting machine in an auto-winder and the number of operations of its thread-knotting monitor in that number of thread knottings; emitting a signal when the number of operations of the thread-knotting monitor reaches a predetermined upper limit; emitting a signal when the number of operations of the thread-knotting monitor at the moment when the number of thread knottings reached the predetermined value falls under a predetermined lower limit; and detecting the monitoring standard of the thread-knotting monitor by the two signals.

That is, the method and the apparatus for detecting the monitoring standard of the thread-knotting monitor according to the present invention are provided on the basis of the following technical ideas.

a. The rate of occurrence of inferior thread knotting, e.g., two-plied threads, relative to the total number of thread knottings is essentially identical in the case where the same thread is continuously wound over a long time by an auto-winder.

b. Thus, it is assumed that fluctuations of the rate of the number of operations of the monitor relative to the total number of thread knottings are caused by fluctuations of the monitoring standard in the thread-knotting monitor or failure of the thread-knotting monitor or the thread-knotting machine.

c. Thus, by constituting an apparatus to emit a signal when the number of operations of the thread-knotting monitor reaches an upper limit or when the number of operations of the monitor at a time the number of thread knottings reaches a predetermined value falls under a predetermined value, it is possible to immediately determine the occurrence of the fluctuations described in item b by means of the signal.

The signal is given to an alarm such as a buzzer or a flashing lamp. Thus, workers can be informed of the occurrence of the fluctuations so the workers can stop the corresponding automatic thread-knotting machine, or the corresponding automatic thread-knotting machine can be stopped directly by the signal.

The thread-knotting monitor of the stopped automatic thread-knotting machine is inspected and maintained by workers as described hereinbefore. In this case, since a signal is emitted each time the number of operations of the thread-knotting monitor reaches the upper limit or each time the number of operations of the thread-knotting monitor falls under the lower limit and inspection work is performed as a result thereof, the occurrence of inferior thread knottings remaining as is in the running thread is considerably reduced.

BEST MODE FOR CARRYING OUT THE INVENTION

An embodiment of the monitoring-standard-fluctuation-detection apparatus in an auto-winder according to the present invention is described in detail referring to the attached drawings.

Figure 1:
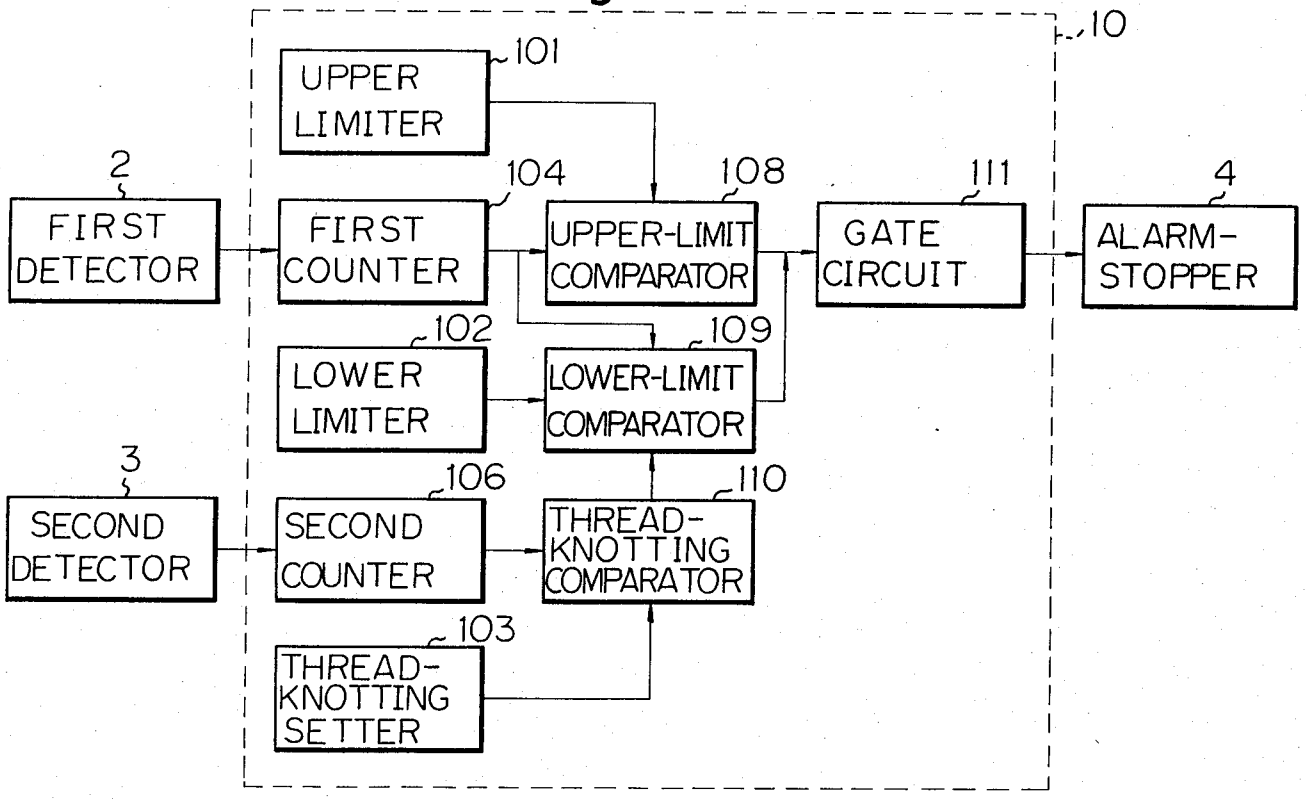
FIG. 1 is a diagram of the constitution of a monitoring-standard-fluctuation-detection apparatus in a thread-knotting monitor according to the present invention.

As shown in FIG. 1, the monitoring-standard-fluctuation-detection apparatus (below, "fluctuation-detection apparatus") according to the present invention is comprised of a first detector 2 for detecting the operation of the thread-knotting monitor (not shown), a second detector 3 for detecting the number of operations of an automatic thread-knotting machine 1, a fluctuation-detection-apparatus body 10 activated upon receipt of a signal from the first detector 2 and the second detector 3, and an alarm-stopper 4 activated upon receipt of a signal from the fluctuation-detection-apparatus body 10.

The fluctuation-detection-apparatus body 10 is comprised of an upper limiter 101, a lower limiter 102, and a thread-knotting setter 103, all set to appropriate values selected in accordance with the thickness of the thread and/or spinning conditions, a first counter 104 for counting the number of operations of the thread-knotting monitor, which number is detected by the first detector 2, a second counter 106 for counting the number of operations of an automatic thread-knotting machine 1, which number is detected by the second detector 3, an upper-limit comparator 108 for comparing the number counted in the first counter 104 with the upper limit of the upper limiter and emitting a signal through a gate circuit 111 to the alarm-stopper 4 when the number counted in the first counter 104 reaches an upper limit of the upper limiter 101, a thread-knotting comparator 110 for comparing the number counted in the second counter 106 with the predetermined value of the thread-knotting setter 103 and emitting a signal when the number counted in the second counter 106 reaches the predetermined value, and a lower-limit comparator 109 comparing the number counted in the first counter 104 with the lower limit of the lower limiter 102 upon receipt of a signal from the thread-knotting comparator 110 and emitting a signal through the gate circuit 111 to the alarm-stopper 4 when the number of the first counter 104 falls under a lower limit of the lower limiter 102 upon receipt of a signal from the thread-knotting comparator 110.

Figure 2:
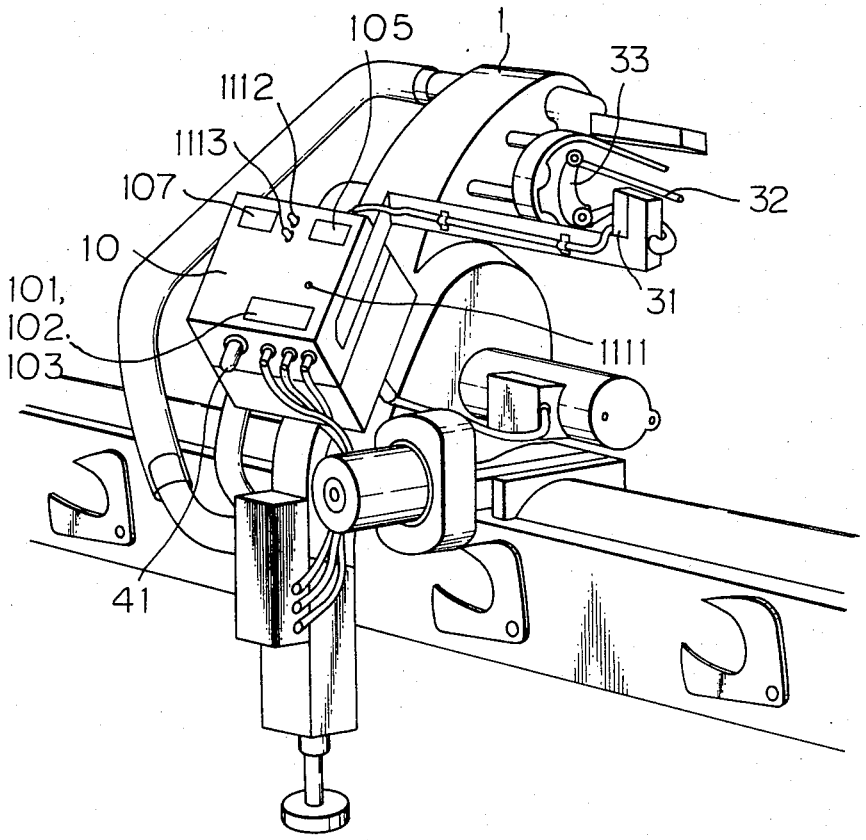
FIG. 2 is a perspective view of an automatic thread-knotting machine provided with an embodiment of the monitor-standard-fluctuation-detection apparatus of FIG. 1 in an auto-winder.
Figure 3:
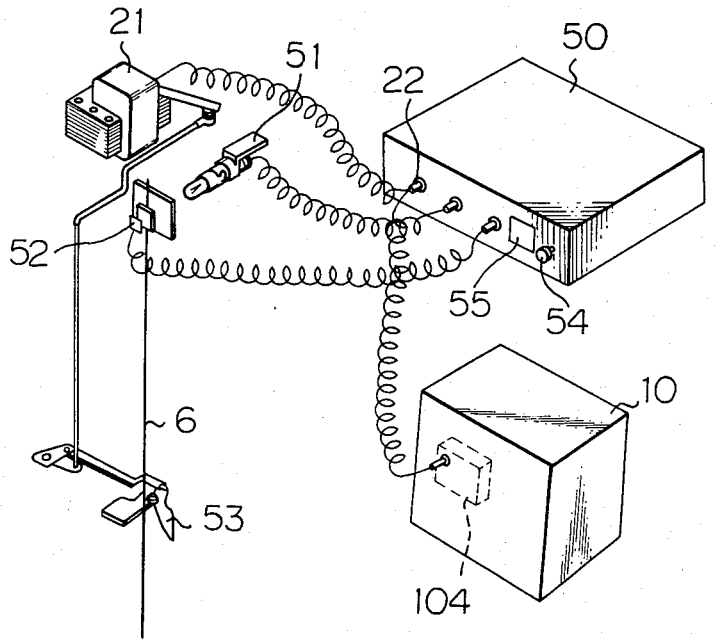
FIG. 3 is a perspective view of a first detector of the monitoring-standard-fluctuation-detection apparatus of FIG. 2.
Figure 4:
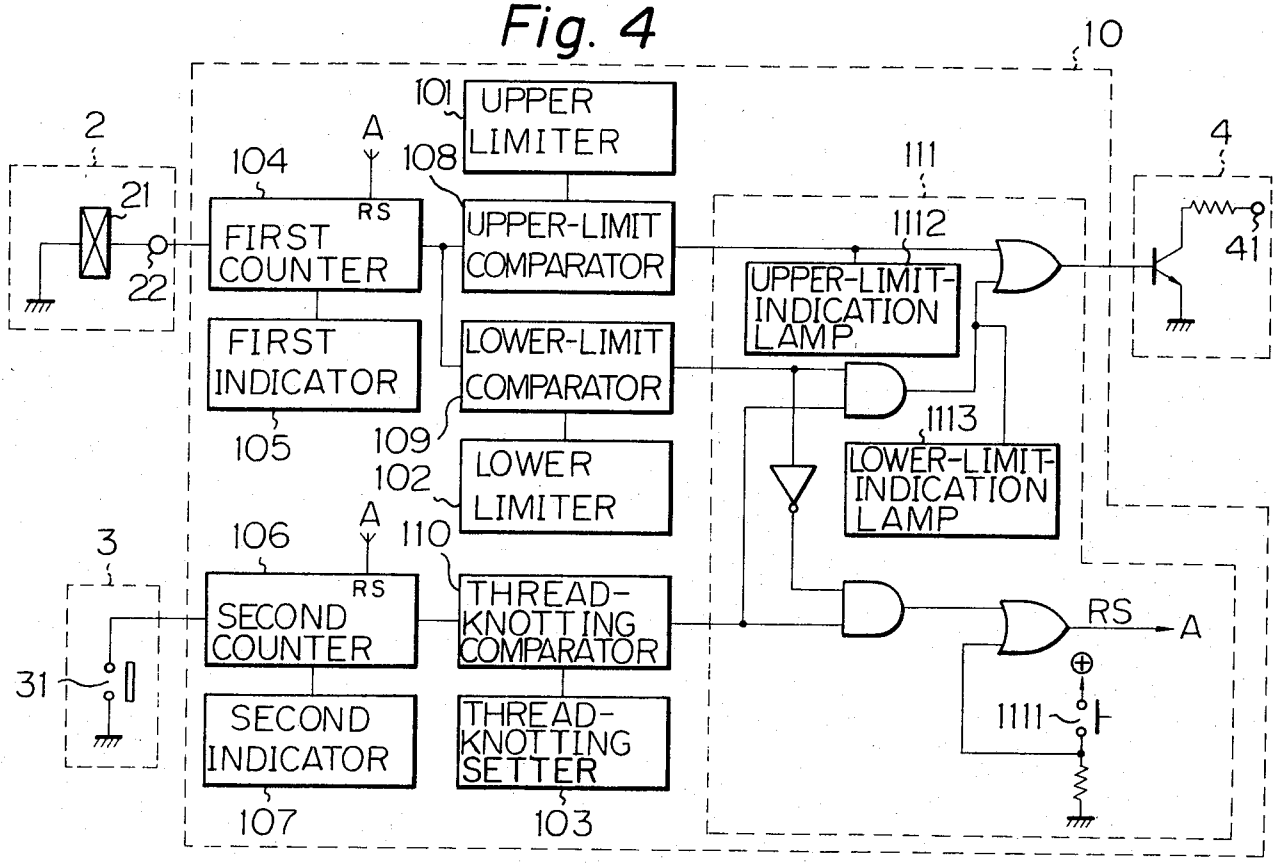
FIG. 4 is a detailed diagram of the constitution of an embodiment of the monitoring-standard-fluctuation-detection apparatus of FIG. 2.

FIG. 2, FIG. 3, and FIG. 4 illustrate a preferred embodiment in the case where the fluctuation-detection apparatus according to the present invention is used in an auto-winder with a movable automatic thread-knotting machine, e.g., the auto-winder made by Schlafhorst GmbH. In this case, the fluctuation-detection-apparatus body 10 is attached to a rear portion of the automatic thread-knotting machine 1 of the auto-winder, i.e., the rear side of the body 10 viewed from the place of the auto-winder where the feeding bobbins are arranged.

FIG. 2 also illustrates the second detector. The thread-knotting mechanism of the automatic thread-knotting machine, of which only the main portion is illustrated in FIG. 2, has an ejector fork 32. The ejector fork 32 has a Y-shaped prong and, with the prong, tightens the thread-knotting portion after thread knotting by moving reciprocally with each thread knotting by a swinging lever 33. The detector in the preferred embodiment according to the present invention is comprised of a limit switch 31 constituted as a noncontact sensor arranged in the moving area of the lever 33. The limit switch 31 is connected to the fluctuation-detection-apparatus body 10 as illustrated in FIG. 2. Therefore, the limit switch 31 can sense each reciprocal movement of the ejector fork 32 and transmit a signal to the second counter in the fluctuation-detection-apparatus body 10.

On the other hand, the preferred embodiment of the fluctuation-detection-apparatus according to the present invention uses as the first detector a device provided on the thread-knotting monitor and instructing the cutting of the inferior thread-knotting portion. That is, as illustrated in FIG. 3, the known thread-knotting monitor in the auto-winder is comprised of a data processor 50, a light-emitting element 51 and a light-detecting element 52 connected to the data processor 50, a solenoid 21 operated by a signal obtained through the data processor 50 from the light-emitting element 52, a cutter 53 operated by the solenoid 21 and cutting the inferior thread-knotting portion of the thread 6 in a running state, a control dial 54 of a controller (not shown) provided in the data processor 50 and controlling the standard thread cutting, and an indicator 55 of the controller. The signal from the data processor 50 to the solenoid 21 in this thread-knotting monitor is transmitted through a lead line from a terminal 22. Thus, in the preferred embodiment of the fluctuation-detection apparatus the first counter 104 is connected to the terminal 22 of the data processor 50 by a lead line and, thereby, the number of operations of the thread-knotting monitor is transmitted to the first counter 104. Therefore, in the preferred embodiment of the fluctuation-detection apparatus according to the present invention, no special device is necessary as the first detector. Consequently, this helps simplify the constitution of the fluctuation-detection apparatus.

In the preferred embodiment of the fluctuation-detection apparatus according to the present invention, the fluctuation-detection apparatus is comprised of a first detector 2, a second detector 3, the fluctuation-detection-apparatus body 10 for processing signals received from the first detector 2 and the second detector 3, and the alarm-stopper 4 operated by a signal received from the fluctuation-detection-apparatus body 10. As explained on the basis of FIG. 1, signals received in the first counter 104 and the second counter 106 are electrically processed and signals are emitted from the upper-limit comparator 108, the lower-limit comparator 109, and the thread-knotting comparator 110, respectively. These signals are processed by the gate circuit 111 illustrated in FIG. 4 as an example, and become signals to the alarm-stopper 4. Further, a reset circuit is provided in the gate circuit. Therefore, by operating a reset button 1111 (FIG. 2 and FIG. 4), it is possible to reset the first counter 104 and the second counter 106. Further, a first indicator 105 and a second indicator 107 are connected to the first counter 104 and the second counter 106, respectively. As a result, it is always possible to confirm the number of operations of the thread-knotting monitor and the automatic thread-knotting machine. Further, the fluctuation-detection-apparatus body 10 is preferably provided with an upper-limit-indication lamp 1112, which switches on when the number of the first counter 104 reaches the upper limit, and a lower-limit-indication lamp 1113, which indicates the fact that the number of the second counter 106 has not reached the lower limit at the predetermined number of thread knottings.

In the preferred embodiment of the fluctuation-detection apparatus according to the present invention, the alarm-stopper 4 is comprised of an alarm lamp 41. However, it is preferably constituted to send a signal to an optimum-position stopper of the automatic thread-knotting machine so as to stop the operation of the automatic thread-knotting machine either along with or independently of the activation of the alarm lamp 41.

The operation of the fluctuation-detection apparatus is explained hereinafter on the basis of FIG. 5. First, the upper limit, the lower limit, and the predetermined value are set in the upper limiter 101, the lower limiter 102, and the thread knotting setter 103, respectively. Since, for example, digital switches are used for these, it is possible to freely set the upper limit, lower limit, and predetermined value depending on spinning condition. For example, 10 may be set as the upper limit, 2 as the lower limit, and 100 as the predetermined value. The number of the first counter 104 and the number of the second counter 106 are cleared to 0 by pushing the reset button 1111. That state can be confirmed by the first indicator 105 and the second indicator 107.

While the auto-winder is operated and the thread knotting proceeds, the number of the first counter 104 is read by the upper-limit comparator 108. On the other hand, the number of the second counter 106 is read by the thread-knotting comparator 110. First, the number of the first counter 104 is compared with the upper limit set in the upper limiter 101 by the upper-limit comparator 108. If the number of the first counter 104 is the same as the upper limit, that is, when the number of the first counter 104 becomes 10, in the above-mentioned example, the upper-limit comparator 108 sends a signal through the gate circuit 111 to the alarm-stopper 4 to cause the alarm lamp 41 to flash and the automatic thread-knotting machine to stop at a suitable position. If the number of the first counter 104 is under 10, the operation of the thread-knotting comparator 10 proceeds.

In the thread-knotting comparator 110, if the number of the second counter 106 is the same as the predetermined value of the thread-knotting setter 103, that is, when the number of the second counter 106 becomes 100 in the above-mentioned example, a signal is sent to the lower limiter 109, the lower limiter 109 is operated, and the number of the first counter 104 is compared with the lower limit of the lower limiter 102. If the number is under the lower limit, that is, when the number of the first counter 104 is 2, 1, or 0 in the above-mentioned example, the lower limiter 109 sends a signal through the gate circuit 111 to the alarm-stopper 4 to cause the alarm lamp 41 to flash and the automatic thread-knotting machine to stop at a suitable position.

Figure 5:
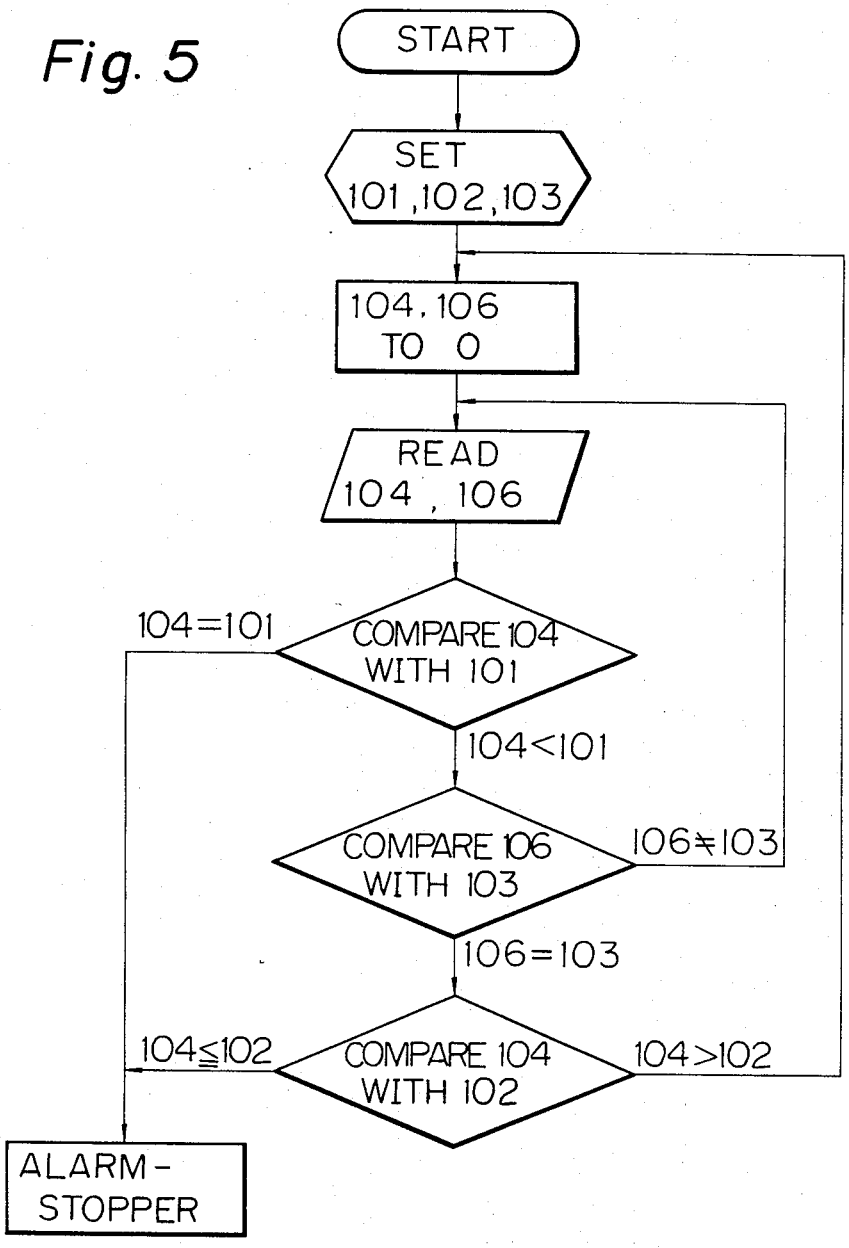
FIG. 5 is a flow-chart of the operation of the monitoring-standard-fluctuation-detection apparatus of FIG. 4.

Further, if the number is not the same as the value set in the thread-knotting setter 103, e.g., 100, or if the number of the first counter 104 is larger than the low limit of the lower limiter 102, as illustrated in FIG. 5, signals are sent before the operation of reading the first counter 104 and the second counter 106 or before the operation of clearing the first counter 104 and the second counter 106 to 0, and the comparison operations are repeated.

As the fluctuation-detection apparatus of the present invention operates as described hereinbefore, when the thread-knotting monitor operates excessively, the alarm-stopper 4 is operated by the operation of the upper-limit comparator 108. When the operation of the thread-knotting monitor is sluggish and it seems the thread-knotting monitor is not operating normally, the alarm-stopper 4 is operated by the operation of the lower-limit comparator 109. Consequently, it is possible to determine if the thread-knotting monitor is operating out of its normal range, i.e., if the thread-knotting monitor is in a defective state. Therefore, workers may inspect and adjust only the thread-knotting monitors in the defective state by using the fluctuation-detection apparatus according to the present invention with the known thread-knotting monitor of the auto-winder. This means a considerable lightening of inspection work for thread-knotting monitors. Further, since the fluctuation-detection apparatus according to the present invention operates continuously during the operation of the auto-winder to monitor the operation of the thread-knotting monitor, and the alarm-stopper is operated immediately when a defective state occurs, defective states do not continue for a long time. This means it is possible to prevent including many inferior thread-knotting portions in a thread package.

CAPABILITY OF EXPLOITATION IN INDUSTRY

The method and the apparatus according to the present invention are combined and used with a thread-knotting monitor of an automatic thread-knotting machine used in the winding process of a spinning factory and are useful for maintaining the thread-knotting monitoring standard in a constant range. However, the method and the apparatus can be used more broadly not only for winding machines for spun yarn, but also for apparatuses in which a thin and long strip such as filament yarn is connected and treated.

We claim:

1. In an auto-winder having an automatic thread-knotting machine and a thread-knotting monitor constructed and arranged to monitor each configuration of a respective thread-knot, with the thread-knotting machine and monitor being cooperatively connected so that when the thread-knotting exceeds a pre-determined monitoring standard a detected inferior portion of the thread is then cut and removed with the remaining portion of the thread being knotted and wound, a method for detecting a fluctuation in the pre-determined monitoring standard, said method including the steps of:

(a) counting the number of thread-knottings produced by the automatic thread-knotting machine;

(b) counting the number of operations of the thread-knotting monitor associated with the number of thread-knottings in step (a);

(c) comparing the number of step (b) with a predetermined upper limit number;

(d) comparing the number of step (b) with a predetermined lower limit number;

(e) emitting a first signal when the number of step (b) equals the pre-determined upper limit number;

(f) emitting a second signal when the number of step (b) is less than the pre-determined lower limit number; and (g) detecting a fluctuation of the monitoring standard of the thread-knotting monitor when a signal is emitted.

2. An apparatus constructed and arranged to detect fluctuation of a monitoring standard of a thread-knotting monitor in an auto-winder having an automatic thread-knotting machine, said apparatus comprising:

(a) first means for detecting an operation of said thread-knotting monitor;

(b) first means, connected to said first detecting means, for counting the number of operations of said thread-knotting monitor detected by said first detecting means;

(c) second means for detecting an operation of the automatic thread-knotting machine;

(d) second means, connected to said second detecting means, for counting the number of operations of said thread-knotting machine detected by said second detecting means;

(e) means for setting a pre-determined number of thread-knotting operations;

(f) an upper limiter associated with said first counting means and having a pre-determined upper limit number for the number of operations of said thread-knotting monitor relative to the pre-determined number of thread-knotting operations;

(g) a lower limiter associated with said first counting means and having a pre-determined lower limit number for the operations of said thread-knotting monitor relative to said predetermined number of thread-knotting operations;

(h) a thread-knotting comparator associated with said second counting means of said thread-knotting machine and said means for setting a pre-determined number of thread-knotting operations;

(i) an upper limit comparator associated with said upper limiter and said first counting means;

(j) a lower-limit comparator associated with said lower limiter and said first counting means;

(k) means for terminating the operation of the auto-winder; and (l) means for interconnecting said operation terminating means with said upper-limit comparator and said lower-limit comparator;

said thread-knotting comparator including means for signalling said lower limiter when the number of operations of said thread-knotting machine equals the pre-determined number set by said setting means;

said lower-limit comparator including means for comparing the number of operations of said thread-knotting monitor received by signal from said thread knotting comparator with said pre-determined lower limit number and means for emitting a signal through said interconnecting means to said operation terminating means when said number of thread-knotting monitor operations is less than said pre-determined lower-limit number;

said upper limiter comparator including means for comparing the number of operations of said thread knotting monitor, received by signal from said first counting means, with said pre-determined upper limit number and means for emitting a signal through said interconnecting means to said operation terminating means when said number of operations of said thread-knotting monitor equals said pre-determined upper limit number.

3. The apparatus according to claim 2 further including means for adjusting each of said pre-determined numbers for said thread-knotting setting means, said upper limiter, and said lower limiter respectively as required by variations in thread thickness.

4. The apparatus according to claim 2 wherein said first detecting means comprises a device constructed and arranged to control cutting of an inferior thread-knotting portion of the thread, said device being located on said thread-knotting monitor and being connected to said first counting means.

5. The apparatus according to claim 2 wherein said second detecting means is a limit switch positioned adjacent a thread-knotting mechanism on the auto-winder.

* * * * *